United States Patent [19]

Olsen et al.

[11] Patent Number: 4,484,047

[45] Date of Patent: Nov. 20, 1984

[54] METAL ENCAPSULATED, PRESSURIZED GAS INSULATED HIGH VOLTAGE SWITCHING APPARATUS

[75] Inventors: Willi Olsen; Sreenivasan S. Kumar, both of Berlin, Fed. Rep. of Germany

[73] Assignee: Siemens Aktiengesellschaft, Munich, Fed. Rep. of Germany

[21] Appl. No.: 367,023

[22] Filed: Apr. 9, 1982

Related U.S. Application Data

[63] Continuation of Ser. No. 49,323, Jun. 18, 1979, abandoned.

[30] Foreign Application Priority Data

Jul. 13, 1978 [DE] Fed. Rep. of Germany ..... 2831134

[51] Int. Cl.[3] ..... H01H 33/42

[52] U.S. Cl. ..... 200/148 F; 200/148 R; 200/148 B

[58] Field of Search ..... 200/148 F, 148 H, 148 R, 200/148 B

[56] References Cited

U.S. PATENT DOCUMENTS

| | | | |
|---|---|---|---|
| 3,725,623 | 4/1973 | Fischer et al. | 200/148 H |
| 3,876,846 | 4/1975 | Graybill | 200/148 F |
| 3,956,605 | 5/1976 | Roidt et al. | 200/148 B |
| 4,132,876 | 1/1979 | Sato et al. | 200/148 H |

*Primary Examiner*—Robert S. Macon

*Attorney, Agent, or Firm*—Kenyon & Kenyon

[57] ABSTRACT

In a metal encapsulated, pressurized gas insulated high voltage disconnect switch operating at voltages above 245 kV, weak arcs drawn during the switching operation are prevented from wandering off, so that they cannot commutate to the encapsulation and produce an arc to ground, by an electric field in the switching gap controlled by moving a field electrode jointly with the switching rod, with the motion cycles of the switching rod and the field electrode controlled during the closing and opening process in a forced manner by a lever linkage provided with steering rods for the switching rod and the field electrode.

7 Claims, 4 Drawing Figures

METAL ENCAPSULATED, PRESSURIZED GAS INSULATED HIGH VOLTAGE SWITCHING APPARATUS

This is a continuation of application Ser. No. 49,323 filed June 18, 1979, now abandoned.

BACKGROUND OF THE INVENTION

This invention relates to metal encapsulated, pressurized gas insulated high voltage switching apparatus in general and more particularly to disconnect switches, of the type having two field electrodes which define, in the "off" position, a switching gap between two potentials, and having a movable switching rod which crosses the switching gap in the "on" position and together with which the field electrode which surrounds the rod coaxially can be moved into an intermediate position which favors the electric field between the two field electrodes during the closing process.

From DE-OS No. 27 11 166, a metal encapsulated, pressurized gas insulated grounding switch for metal encapsulated high voltage switching installations is known, the switching rod of which is coaxially surrounded by a field electrode. During the closing process, this field electrode is moved in the same direction as the switching rod and transferred to a position closer to the mating stationary contact. Thereby, the breakdown spacing is reduced in this known high voltage switch. The effect of the field electrode is to delay the firing instant of the arc. The movement of the field electrode is accomplished by friction at the switching rod; it accordingly depends on factors determining the friction contact such as, for instance, heating, wear and manufacturing tolerances. Due to the free movement of the field electrode between two fixed stops chosen for the motion, the electrode is carried along even at the beginning of the switching off process when the grounding switch is opened.

In high voltage switch gear such as disconnect switches, which switch at velocities of about 4 cm/sec, the movable switching rod is, as a rule, actuated by a motor drive. The switching on time is then between 5 and 10 sec, depending on the size of the switching gap which depends on the rated voltage. If disconnect switches of this type are switched on, a pre-breakdown with a subsequent low current arc always occurs if the disconnect switch is switched under voltage. The duration of the preliminary arc can then be several seconds, depending on the circumstances.

In the known designs of disconnect switches which are suitable for voltages up to 245 kV, this breakdown gap is so small, especially in sulfur hexafluoride which is used as the quenching and insulating medium in metal encapsulated installations, that the arc is not expected to wander off while it is burning.

In disconnect switches for voltages higher than 245 kV, the pre-breakdown length of the arc is larger because of the longer switching gap so that the danger exists that the arc, while it burns, will travel away from its point of origin and settles at the grounded encapsulation of the installation.

When disconnect switches are opened, arcs that can similarly wander off can occur during the opening operation, for instance, due to unavoidable charges on the connected transmission lines, especially cables. If the arc wanders away from its point of origin and settles at the grounded encapsulation of the installation, the danger exists that parts of the installation will be destroyed due to the then existing short to ground.

SUMMARY OF THE INVENTION

It is an object of the present invention to describe metal encapsulated pressurized gas insulated high voltage switching apparatus, especially disconnect switches of the type mentioned at the outset, in which wandering off of the arc during the closing and opening process is prevented.

According to the present invention, this is accomplished by a lever linkage which is provided with steering rods for the switching rod and the field electrode and which controls the motion cycles of the switching rod and the field electrode during the closing and opening process.

Through the application of the present invention, it is ensured that the field electrode moves, during the closing process, as well as during the opening process, unequivocally and independently of heating, wear and manufacturing tolerances. In addition, a favorable electric field between the field electrodes is also obtained by the forced control of the field electrode during the switching processes. The arc, which is drawn with relatively little length, burns between two electrodes, the spacing of which, relative to the diameter of the encapsulator, can be designed so that the field between the electrodes exerts a strong influence on the arc, while the influence of the field influenced by the encapsulation is similarly kept small.

In one preferred embodiment according to the present invention, the steering rods are linked to cranks which are connected to each other with great angular stiffness and are fastened in a torsion proof manner on a common rotatable shaft. In this embodiment, the steering rods can be coupled directly to the switching rod or to the field electrode. This results in a motion in opposite directions between the field electrode and the switching rod which sets in at the beginning of the switching operations but is unimportant for the operation of the high voltage disconnect switch. If the switching rod is to be prevented from traversing the space between the two field electrodes, during the opening process as well as during the closing process, until the movable field electrode has reached a given intermediate position, it is advantageous to couple the steering rod for the switching rod to the switching rod via a connecting rod and to guide the joint between the steering rod and the connecting rod in a stationary, curved guide rail.

Two examples of a metal encapsulated pressurized gas insulated high voltage switching apparatus according to the present invention, designed as a disconnect switch, will be described with the aid of the drawings.

DETAILED DESCRIPTION OF THE INVENTION

Figure 1:
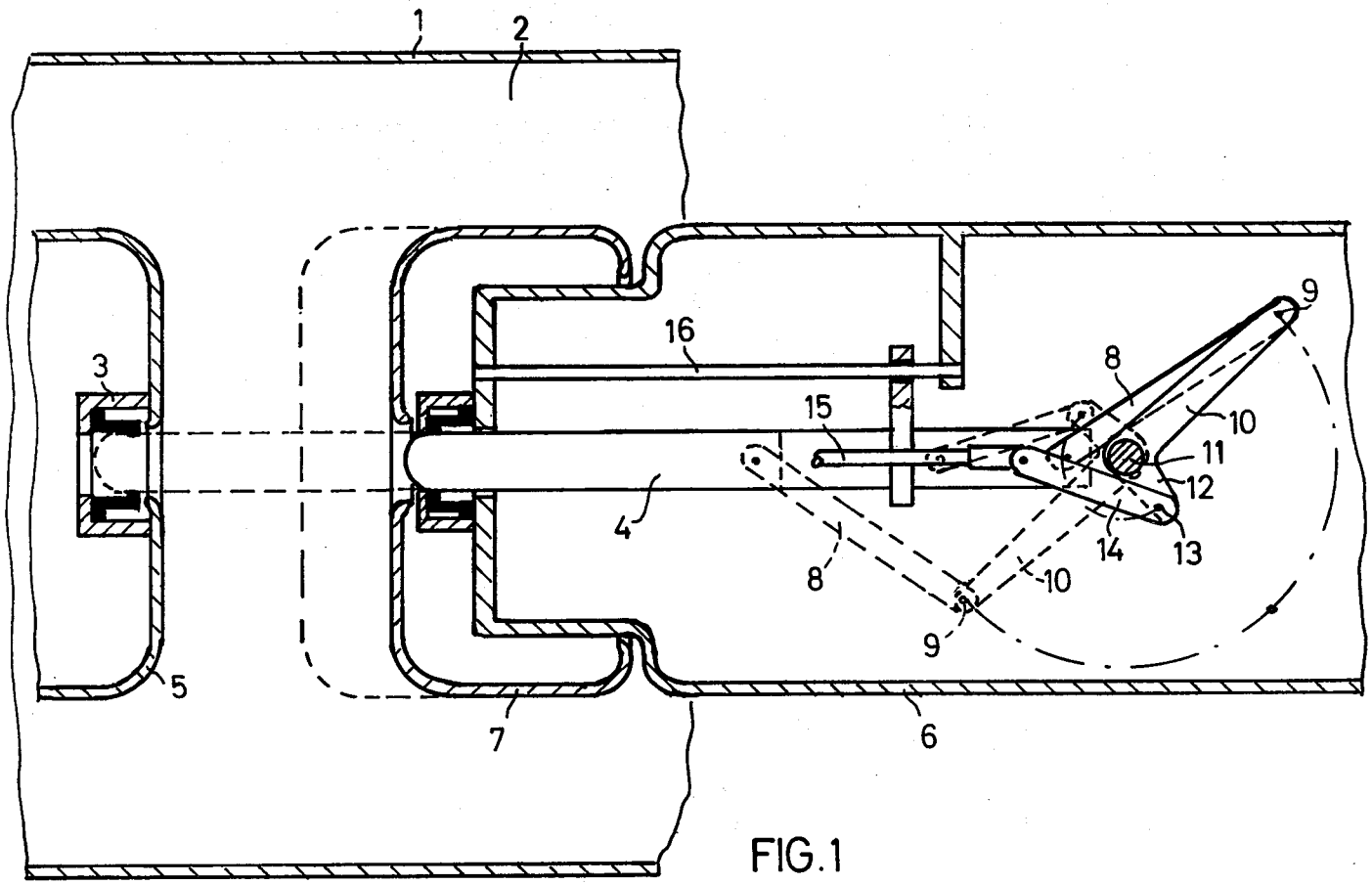
FIG. 1 shows, diagrammatically, in a cross sectional view, a high voltage disconnect switch for metal encapsulated pressurized gas insulated high voltage switching installations.

The high voltage disconnect switch shown in FIG. 1 is intended for metal encapsulated, pressurized gas insulated high voltage switching installations with nominal voltages of preferably above 245 kV. It has a tubular outer encapsulation 1 which consists of metal and as a rule is at ground potential. In its interior 2, the encapsulation 1 contains a gaseous insulating medium, particularly sulfur hexafluoride at a pressure of, for instance, 5 bar. In the interior 2, the contact system of the high voltage disconnect switch and the essential parts of the drive are arranged. The high voltage disconnect switch has a fixed contact 3 which cooperates with a movable switching rod 4. The fixed contact 3 is surrounded by a field electrode 5.

The switching rod 4 runs inside a support tube 6. It is surrounded by a field electrode 7. The switching rod 4 is connected to a steering rod 8 which is connected to a crank 10 via a joint 9. The crank is mounted, secure against torsion, on a drive shaft 11, on which a further crank 12 is fastened in a torsion proof manner.

To the crank 12 is connected, via a joint 13, a second steering rod 14 which actuates a rod 15. The rod 15 drives the electrode 7, as can be seen from FIG. 2.

When the contact system of the high voltage disconnect switch is transferred from the "off" position shown by the solid lines into the "on" position shown by the dashed lines, the crank 10 and the crank 12 are rotated 180° by the shaft 11. This brings the switching rod 4 into engagement with the fixed contact 3 and at the same time moves the field electrode 7. As long as the field electrode 7 is being transferred into the position near the electrode 5, the switching rod 4 is held back. In this manner, the electric field between the electrodes 5 and 7 is not yet stressed by the tip of the switching rod 4. The influence of the field which results from the outer metal encapsulation remains relatively small in this closer position of the electrodes if the switching rod subsequently traverses the space between the electrodes 5 and 7. An arc that might occur cannot be influenced by the field of the grounded encapsulation 1. A corresponding effect is obtained during the opening motion.

Figure 2:
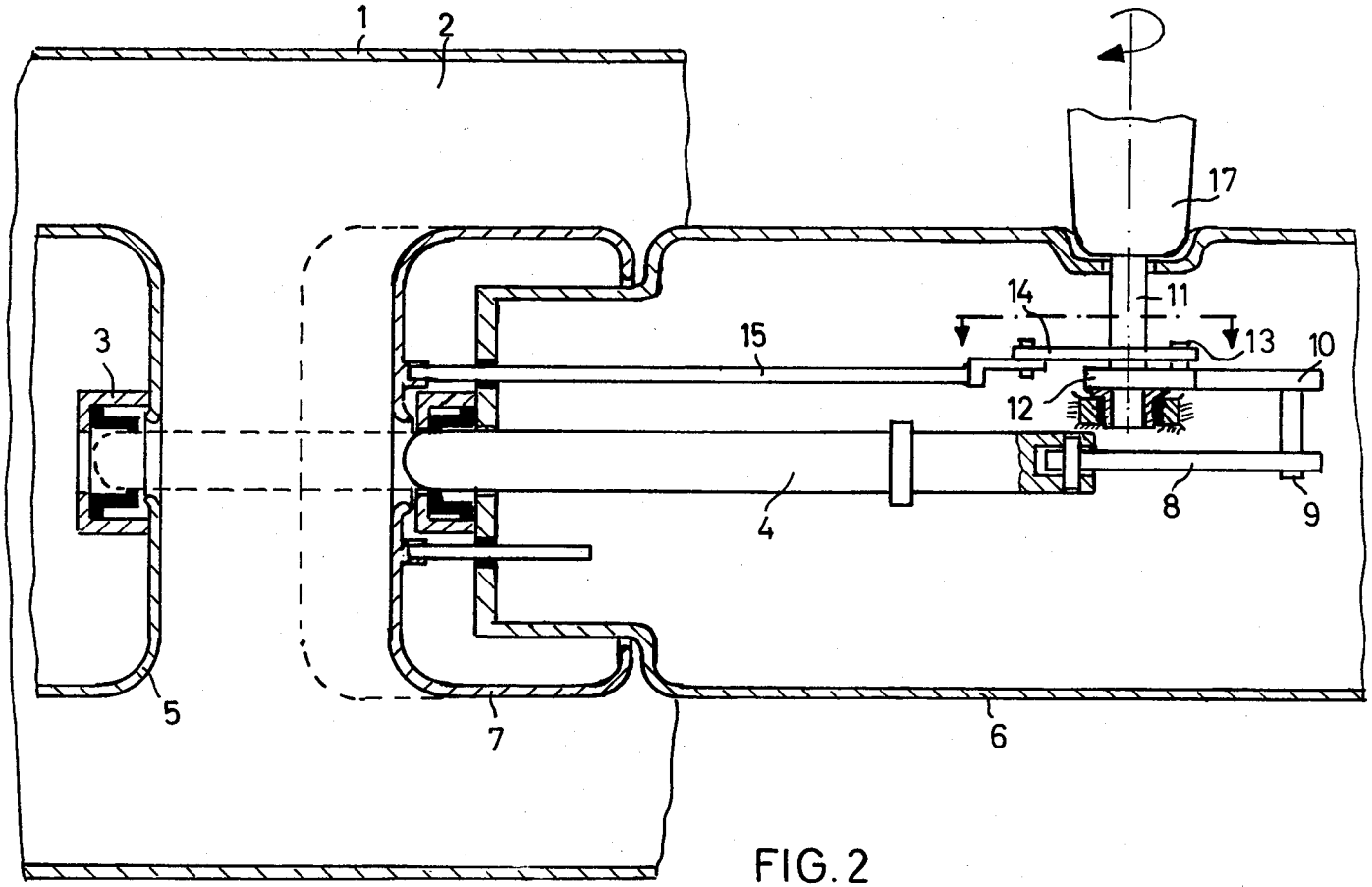
FIG. 2 is a side elevation corresponding to FIG. 1.

A guiding rod 16, which is arranged inside the support tube 6 parallel to the axis for guiding the switching rod 4, is shown in FIG. 2. Otherwise, like parts in FIG. 2 are provided with the same reference symbols. FIG. 2, in addition, shows a drive insulator 17 for the shaft 11.

Figure 3:
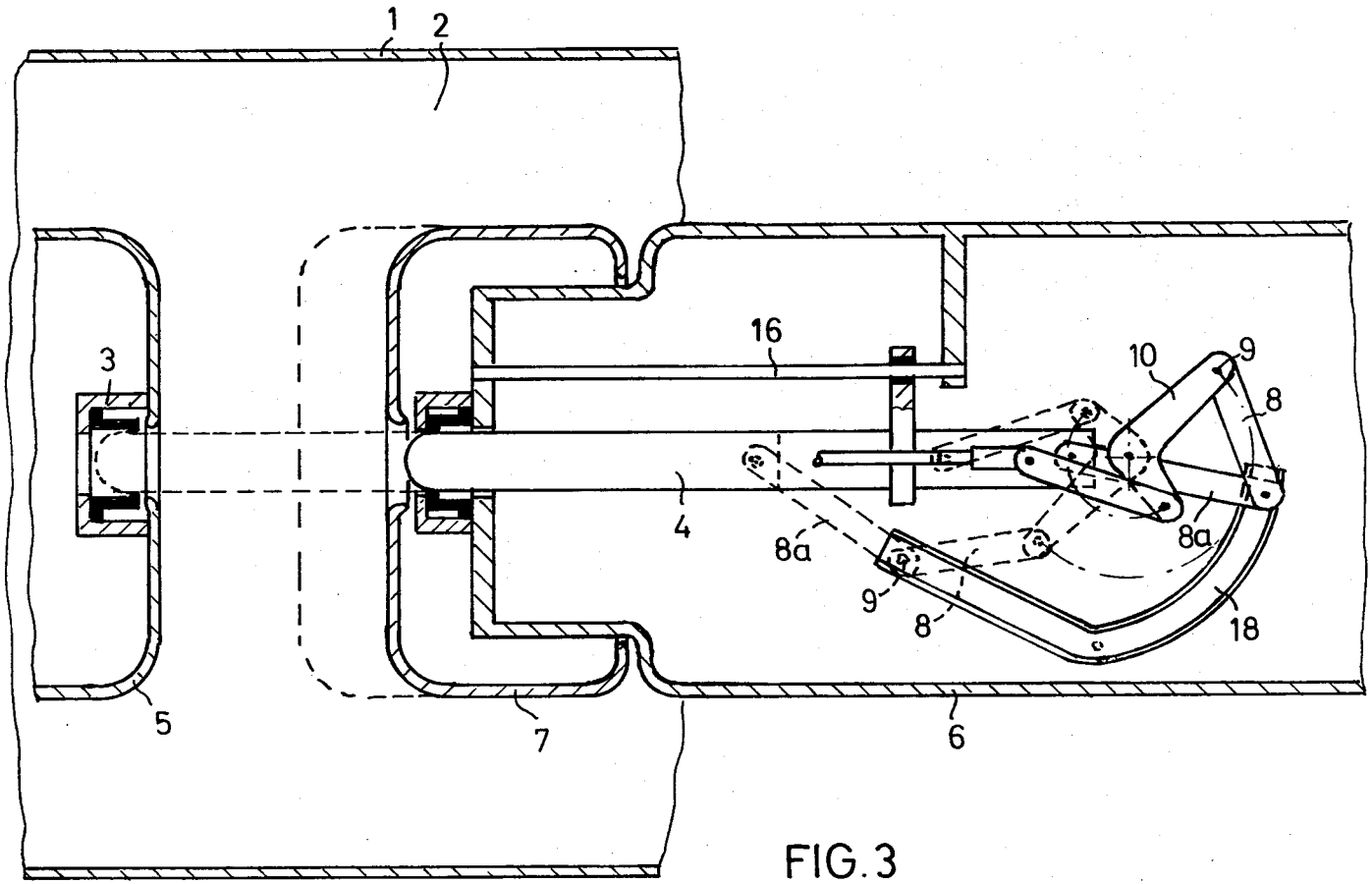
FIG. 3 shows a somewhat different embodiment of a high voltage disconnect switch according to the present invention.
Figure 4:
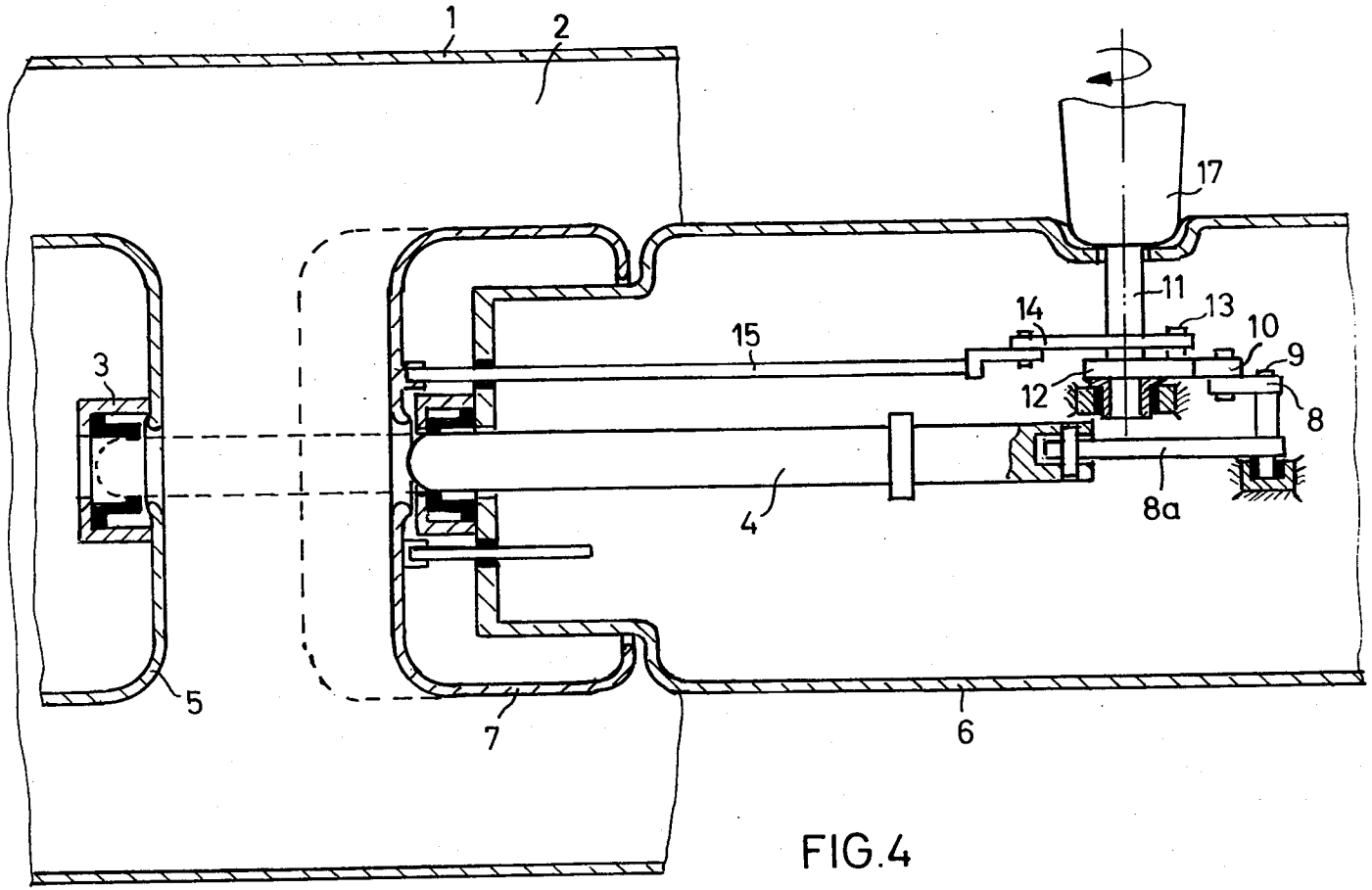
FIG. 4 is a diagrammatic side elevation corresponding to FIG. 3.

In the embodiment shown in FIGS. 3 and 4, like parts are shown with the same reference symbols as in FIGS. 1 and 2. The difference between this embodiment and the previous one is that the joint 9 runs in a stationary curved guide 18, so that a controlled motion of the switching rod 4 during the closing and opening process using a different kind of control is obtained. This embodiment with the stationary, curved guide rail 18 requires, besides the crank 10 and the steering rod 8, a connecting rod 8*a* for moving the switching rod 4.

What is claimed is:

1. In metal encapsulated, pressurized gas insulated high voltage switching apparatus including two field electrodes which define, in the "off" position, a switching gap between two potentials and a movable switching rod which is surrounded by one of said field electrodes and which crosses the switching gap in the "on" position, said switching rod and surrounding field electrode adapted for movement during the closing process into an intermediate position favoring the field between the two field electrodes, the improvement comprising means, including a mechanical lever linkage having steering rods for the switching rod and the field electrode, arranged to control, in a forced manner, the motion cycles of the switching rod and the field electrode during the closing and opening process such that during closing the movable field electrode reaches its "on" position before said movable switching rod is moved to cross the switching gap to reach its "on" position and during opening a corresponding effect is obtained.

2. The improvement according to claim 1 and further including a rotatable shaft, and cranks connected to each other with great angular stiffness secured to said shaft in a torsion-proof manner and wherein said steering rods are linked to said cranks.

3. The improvement according to claim 1 or 2, wherein said steering rods are directly coupled to the switching rod and the field electrode, respectively.

4. The improvement according to claim 1 or 2 and further including a connecting rod coupling the steering rod for the switching rod to the switching rod a joint being formed between said connecting rod and switching rod and a stationary, curved guide rail for guiding said joint between said steering rod and said connecting rod.

5. A metal clad, pressurized gas insulated high voltage switching apparatus comprising a fixed field electrode and a movable field electrode which define, in an "off" position, a switching gap between two potentials and a movable contact rod which is surrounded by said movable field electrode and which crosses the switching gap in the "on" position to engage a fixed contact, said contact rod and surrounding field electrode being adapted for movement during closing and opening of the switching apparatus into an intermediate position in which said field electrodes are close together while the contact rod is retracted from the gap, a fixed linkage mechanical drive arrangement being coupled to the contact rod and surrounding field electrode and arranged to drive them together along predetermined relative paths towards and away from the fixed contact and field electrode, wherein said predetermined relative paths are such that: in a circuit-closing operation, when the movable field electrode and contact rod are moved from respective end positions furthest from the fixed field electrode and contact the movable field electrode initially travels in advance of the contact rod until the movable field electrode reaches an end position nearest the fixed field electrode, whereafter the contact rod continues its travel towards the fixed contact until it establishes contact therewith, and in a circuit-opening operation the motion is corresponding.

6. A switching apparatus according to claim 5, wherein said drive arrangement includes a rotatable shaft, first and second cranks rigidly secured to said shaft, a first driving link interconnecting said first crank and said contact rod and a second driving link interconnecting said second crank and said movable field electrode.

7. A switching apparatus according to claim 6 and further including a connecting rod coupling the first driving link for the contact rod to the contact rod, a joint being formed between said connecting rod and contact rod and a stationary, curved guide rail for guiding said joint between said first driving link and said connecting rod.

* * * * *